United States Patent [19]

De La Plaza et al.

[11] Patent Number: 4,703,249

[45] Date of Patent: Oct. 27, 1987

[54] STABILIZED CURRENT GENERATOR WITH SINGLE POWER SUPPLY, PARTICULARLY FOR MOS INTEGRATED CIRCUITS

[75] Inventors: Alejandro De La Plaza, Bergamo; Guido Torelli, S. Alessio, both of Italy

[73] Assignee: SGS Microelettronica S.p.A., Catania, Italy

[21] Appl. No.: 889,918

[22] Filed: Jul. 28, 1986

[30] Foreign Application Priority Data

Aug. 13, 1985 [IT] Italy ..... 21924 A/85

[51] Int. Cl.[4] ..... G05F 3/26

[52] U.S. Cl. ..... 323/316; 323/280; 323/281

[58] Field of Search ..... 323/312, 315–316, 323/280–281; 307/490, 491

[56] References Cited

U.S. PATENT DOCUMENTS

| | | | |
|---|---|---|---|
| 4,251,743 | 2/1981 | Hareyama | 323/316 X |
| 4,393,351 | 7/1983 | Gregorian et al. | 307/491 X |
| 4,458,200 | 7/1984 | Geller | 323/316 |
| 4,484,089 | 11/1984 | Viswanathan | 307/491 X |
| 4,618,814 | 10/1986 | Kato et al. | 323/281 X |

*Primary Examiner*—Peter S. Wong

*Attorney, Agent, or Firm*—Wenderoth, Lind & Ponack

[57] ABSTRACT

A stabilized generator includes an operational amplifier with capacitive negative feedback whose output signal controls a current regulator which drives the input of a current mirror circuit, the mirrored current from the mirror circuit controlling a feedback circuit adapted to drive the operational amplifier in order to maintain the mirrored current constant. The feedback circuit includes: a first capacitor and a first electronic switch, in parallel, with one end at a fixed voltage and the opposite end fed by the mirrored current; a second capacitor with an end at the fixed voltage and the opposite end connected to a second electronic switch adapted to connect the second capacitor to an inverting input of the operational amplifier in a first, inactive, position, and to the free end of the first capacitor in a second, active position, the second electronic switch being controlled synchronously with the first electronic switch by a square-wave clock signal, in such a way that the first electronic switch is alternately open while the second electronic switch is in its active position and closed while the second electronic switch is in its inactive position; furthermore, the non-inverting input of the operational amplifier is connected to a fixed reference voltage source.

9 Claims, 6 Drawing Figures

STABILIZED CURRENT GENERATOR WITH SINGLE POWER SUPPLY, PARTICULARLY FOR MOS INTEGRATED CIRCUITS

BACKGROUND OF THE INVENTION

1. Field of the Invention

This invention relates to a stabilized current generator, particularly suitable for being built-in in integrated circuits of the MOS (Metal-Oxide-Semiconductor) type.

In integrated circuits, the need often arises to generate, inside the circuit itself, a current of a desired value. A typical example is represented by the biasing stage of an operational amplifier.

It is known to use, for this purpose, current generators such as the Wilson generator, or the cascode generator ("Basic MOS Operational Amplifier Design—An Overview", Section IIc, by P. R. Gray, in *Analog MOS Integrated Circuits,* IEEE Press, New York, 1980, page 28; and "Design Considerations in Single-Channel MOS Analog Integrated Circuits—A Tutorial", Section II, by Y. P. Tsividis, in *IEEE Journal of Solid-State Circuits,* vol. SC-13, No. 3, June 1978, p. 383).

Such generators, however, are only suitable for applications in which a high accuracy of the value of the current is not required, particularly when the current variations due to variations of the electric and physical parameters of the integrated circuit (such as conduction factors and threshold voltages of transistors, resistance per square of the resistive layers, etc.) and of the environmental and operating conditions of the circuit itself (e.g. supply voltages, temperature, etc.) do not pose a problem.

When, however, a very accurate value of generated current is required, for example within ±10% of the rated value, also taking into account the variations of the electric and physical parameters of the manufacturing process of the integrated circuit, and furthermore it is required that said value is substantially independent from the operating conditions, in particular from the value of the supply voltage and from the temperature, the above mentioned generators are no longer satisfactory.

It is thus known in these cases to use current mirror generators, in which the driving current is obtained starting from a reference voltage (which is usually available with a very high accuracy on the integrated circuit). The obvious way to obtain such a driving current would be to apply said reference voltage across a resistor having a very accurate value. Since implementing a resistor having an accurate and constant value is difficult in MOS-type circuits, where, on the other hand, it is easy to provide capacitive elements having a sufficiently accurate and constant value, it is also known to achieve an equivalent result by employing circuit means using switched capacitors, the switching being performed by electronic switches controlled by a clock signal (see, e.g., "Sampled Analog Filtering Using Switched Capacitors as Resistor Equivalents", by J. T. Caves, M. A. Copeland, C. F. Rahim and S. D. Rosenbaum in *IEEE Journal of Solid-State Circuits,* vol SC-12, No. 6, December 1977).

SUMMARY OF THE INVENTION

A known embodiment of a stabilized current generator according to the above described art is disclosed in detail hereinafter with reference to FIG. 1. As it will be better understood from the following disclosure, the known solution has the disadvantage of requiring two power supplies with opposite polarities, in addition to the ground and the reference voltage. Another disadvantage is the great number of electronic switches associated with the switched capacitors, practically no less than five, and in some instance seven, simple switches, four or six of which are paired to form change-over switches.

The main object of the present invention is therefore to provide a generator of current having a fixed and stable value which requires only one power supply voltage, and that, since it requires a smaller number of switches, is simpler from a circuit viewpoint as compared with the known solution.

Another object is to provide such a current generator with a filtering time constant which can be determined more easily during the design step, and occupying a smaller silicon area than in the known solution.

The invention achieves the above objects, as well as other objects and advantages, such as will better appear hereinafter, with a stabilized current generator, particularly for MOS integrated circuits, comprising an operational amplifier with capacitive feedback, the output signal of which controls current adjustment means which drive the input section of a current mirror circuit, the current mirrored by said mirror circuit controlling feedback circuit means adapted to drive said operational amplifier in order to maintain constant said mirrored current, characterized in that said feedback circuit means comprise a first capacitor and a first electronic switch in parallel, with one end at a fixed voltage and the opposite end supplied by said mirrored current, a second capacitor with one end at said fixed voltage and the opposite end connected to a second double electronic switch adapted to connect said second capacitor to the inverting input of said operational amplifier in a first, inactive, position, and to the free end of said first capacitor in a second, active, position, said second electronic switch being controlled synchronously with said first electronic switch by a square-wave clock signal so that the first electronic switch is alternately open while the second electronic switch is in its active position, and closed, while the second electronic switch is in its inactive position, and in that the non-inverting input of the operational amplifier is connected to a fixed reference voltage source.

BRIEF DESCRIPTION OF THE DRAWINGS

A typical example of a known type of solution will now be described, together with a few preferred embodiments of the invention, given by way of non-limitative example only, with reference to the accompanying drawings, where.

DETAILED DESCRIPTION OF THE PREFERRED EMBODIMENTS

Figure 1:
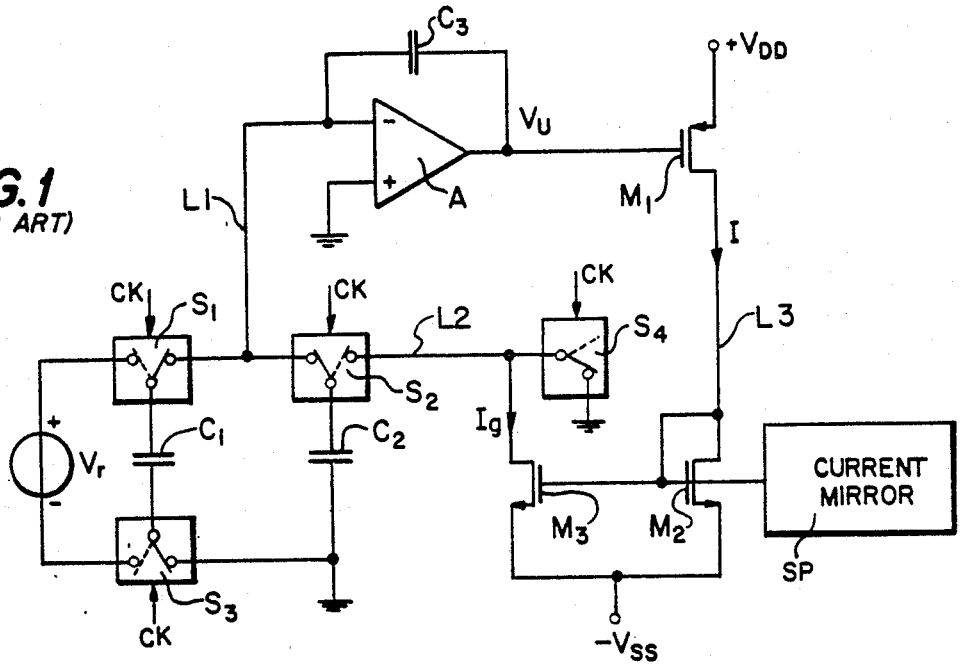
FIG. 1 (PRIOR ART)
FIG. 1 is a circuit diagram of a stabilized current generator for MOS integrated circuits, with switched capacitors, according to the known art.

With reference to FIG. 1, a stabilized current generator according to the known solution described in the introduction comprises a first capacitor $C_1$ and a second capacitor $C_2$, with three double throw electronic switches, $S_1$, $S_2$, $S_3$, shown in the drawing in their rest positions, in which the two capacitors are located in parallel, with one end grounded and the opposite end connected to a conductor L1. When they are in the complementary active positions (represented by dotted lines in the drawing), the two double throw switches $S_1$, $S_3$ disconnect the first capacitor $C_1$ from the other capacitor $C_2$ and connect it across a reference voltage supply $V_r$, while the capacitor $C_2$ is connected to a conductor L2, in order to be charged by a current as will be explained below.

Figure 2:
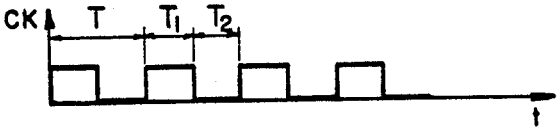
FIG. 2 (PRIOR ART)
FIG. 2 is a diagram of the waveform of a clock signal employed on the integrated circuit.

The three double throw switches $S_1$, $S_2$, $S_3$ are controlled by a same clock signal CK, consisting in a square wave as shown in FIG. 2, with a period T comprising a mark time $T_1$ of high or active signal, and a rest time $T_2$ (typically equal to $T_1$) of low or inactive signal. Each of the three double throw switches $S_1$, $S_2$, $S_3$ consists in practice, as is obvious for a person skilled in the art, in two simple switches controlled by opposite and non-overlapping phases of the clock signal.

Conductor L1 is connected to the inverting input of an operational amplifier A, having its other input grounded, and a capacitor $C_3$ in negative feedback.

The output of amplifier A drives a P-channel transistor $M_1$, having it source electrode supplied by a positive voltage $+V_{DD}$, to generate within conductor L3 a current I whose value therefore depends on the amplifier's output voltage. The current I is mirrored in a current mirror circuit comprising an N-channel transistor $M_2$, having its drain connected to the conductor L3, its gate electrode connected both to its own drain and to the gate electrode of an identical transistor $M_3$, the source electrodes of the two transistors $M_2$ and $M_3$ being connected to a negative supply voltage $-V_{SS}$, all of which is known for current mirror circuits. Therefore a current $I_g$ is generated in the transistor $M_3$, which mirrors the current I.

The drain electrode of the transistor $M_3$ is connected to conductor L2, as well as to an end of a simple switch $S_4$ which is normally closed to ground, and controlled by the clock signal CK to open during the active phase thereof, and therefore the drain of the transistor $M_3$ is connected alternately to ground and to capacitor $C_2$.

The circuit SP, diagrammatically shown in block form, is another current mirror which mirrors the current $I_g$ to supply the stabilized current to the load (not shown).

Substantially, operational amplifier A with capacitor $C_3$ integrates the sum of the charges present on capacitors $C_1$ and $C_2$ at the end of each semiperiod $T_1$ of the clock signal. In running conditions, the output voltage of amplifier A, and therefore the current $I_g$, must be constant, and this means that the integrated charge during each period T is null, i.e. that the charge $C_1V_r$ present on capacitor $C_1$ at the end of the semiperiod $T_1$ is equal, but of opposite sign, to the charge $-I_gT_1$ present on capacitor $C_2$ at the end of the semiperiod $T_1$ ($C_2$ is discharged to the ground during the semiperiod $T_2$). Any change from this ideal situation will cause an imbalance of the charges which will change the output voltage $V_U$ of operational amplifier A so as to restore the balance.

In steady-state conditions, therefore, the current generated by the mirror will be:

$$I_g = C_1 V_r / T_1 \quad (1)$$

and can therefore be controlled with high accuracy, since the reference voltage $V_r$ can be obtained with a high degree of accuracy by using, for example, the barrier potential of silicon, and also capacitor $C_1$ can be manufactured with great accuracy using the monolithic integration technology. The time interval $T_1$, finally, can be set by starting from an oscillator which employs a quartz crystal or a ceramic resonator. The three quantities involved are largely independent from the environmental and operating conditions of the integrated circuit.

Figure 3:
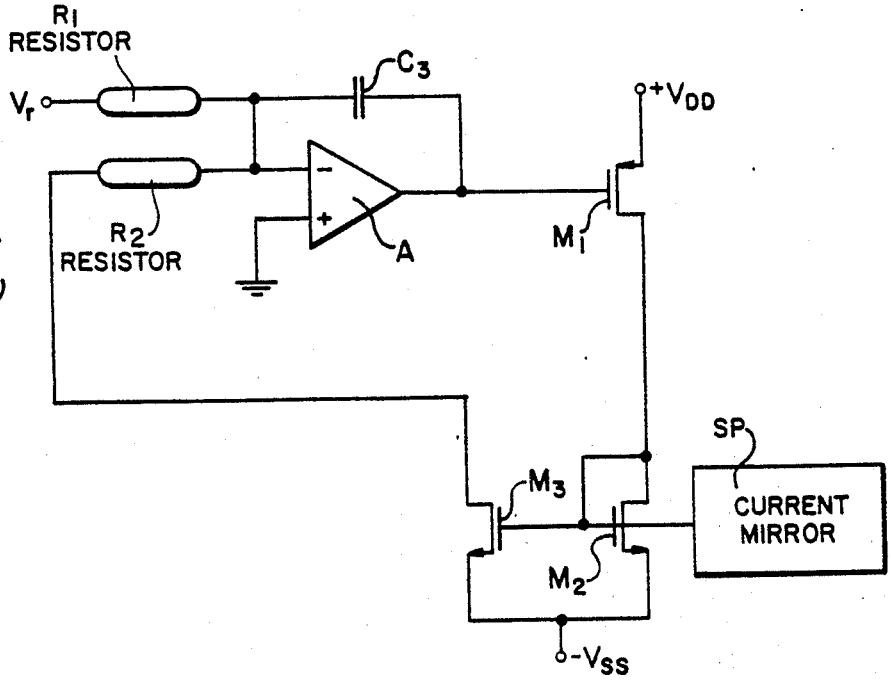
FIG. 3 (PRIOR ART)
FIG. 3 is a time-continuous circuit diagram equivalent to the one of FIG. 1.

FIG. 3 shows, by way of illustration, the time-continuous circuit equivalent to the one of FIG. 1, in which the two resistors $R_1$ and $R_2$ have the values $$R_1 = T/C_1$$

and $$R_2 = T_1/C_2$$

of equivalence to the switched capacitors $C_1$ and $C_2$, according to the usual methods or analysis for switched-capacitor circuits, known to a person skilled in the art.

It will now be understood that the need for a double power supply and for a relatively high number of electronic switches is essentially due to the fact that the charges on the capacitors $C_1$ and $C_2$ must have opposite signs, in order to be compared by the integrator (A, $C_3$), which reacts until it cancels the difference of their absolute values. Switch $S_3$ may be dispensed with if the reference voltage generator has a grounded end, but even so the circuit complexity is still considerable.

Figure 4:
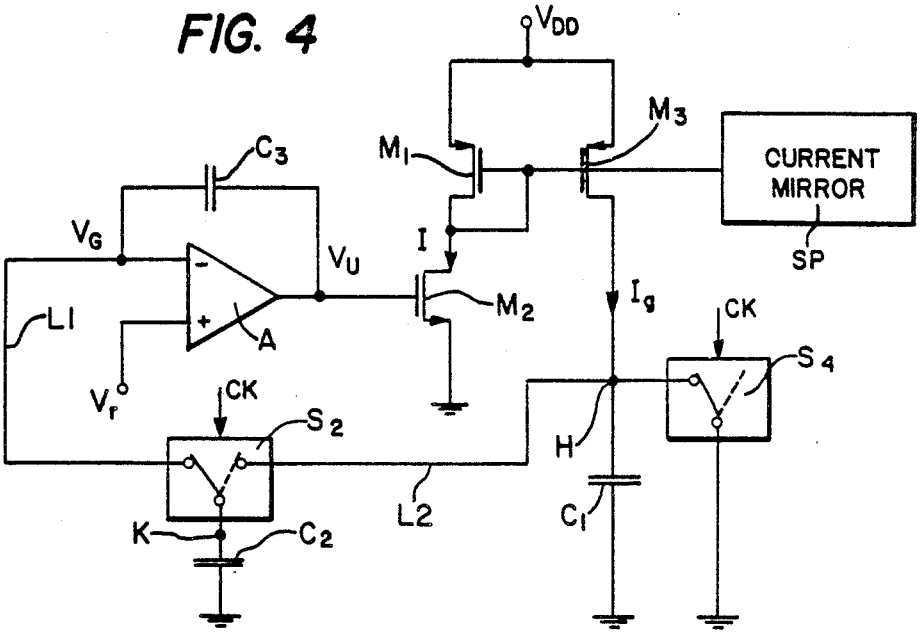
FIG. 4 is a circuit diagram of a stabilized current generator according to a preferred embodiment of the invention.

With reference to FIG. 4, a preferred embodiment of a stabilized current generator according to the invention will now be described.

Similarly to the known solution, the generator of the invention comprises an operational amplifier A negatively fed back by a capacitor $C_3$ in order to act as an integrator, driving an N-channel transistor $M_2$, having in this case its source electrode grounded. The non-inverting input terminal of operational amplifier A is connected to a generator of a fixed reference voltage $V_r$, not shown in the figure. As is known to a person skilled in the art, the inverting input terminal of the operational amplifier acts as a virtual ground ($V_G$), so that in steady-state conditions the potential difference between the two input terminals is substantially zero.

The drain current I of transistor $M_2$ is mirrored in a P-channel current mirror, comprising two transistors $M_1$, $M_2$, connected in a similar way to the circuit of FIG. 1, with the source electrodes connected to a positive power supply $V_{DD}$. The output branch of the mirror, in which the mirrored current $I_g$ flows, is connected to a node H, from which depart a capacitor $C_1$ having its opposite end grounded, an electronic switch $S_4$ connected parallel to the capacitor $C_1$, and finally a conductor L2 leading to a terminal of a double throw electronic switch $S_2$, having the fixed terminal K connected to an end of a second capacitor $C_2$ having its opposite end grounded. The other terminal of the double throw switch $S_2$ is connected to a conductor L1 which leads to the inverting input of operational amplifier A.

The two switches $S_4$, $S_2$ are shown in their rest conditions, and are controlled by a clock signal CK, which can be substantially the same shown in FIG. 2. Therefore in the semiperiods $T_1$ the two switches are actuated, i.e. in their complementary positions, shown by dotted lines in the figure.

In normal steady-state conditions, the transistors $M_1$, $M_2$, $M_3$ operate in their saturation zone. The current I depends on the value of the output voltage $V_U$ of operational amplifier A, and this is true also for the mirrored current $I_g$, which is identical (less a preset multiplying factor, which may be unitary) to the current I.

As in FIGS. 1 and 3, the block SP in FIG. 4 also represents a further current mirror suitable for supplying the stabilized output current to a load (not shown in the figure).

In the semiperiod $T_2$ (switches as shown in solid lines in FIG. 4), capacitor $C_1$ discharges to ground through switch $S_4$. In the following semiperiod $T_1$, switch $S_4$ opens and switch $S_2$ switches to the position shown by the dotted lines, in order to connect the capacitor $C_2$ in parallel to capacitor $C_1$. At the end of the semiperiod $T_1$ the voltage on the node K will therefore be:

$$V_K = I_g T_1/(C_1+C_2) \quad (2)$$

After the end of the interval $T_1$ the switch is again switched to the position of the figure, so as to transfer to capacitor $C_3$ the charge present on the capacitor $C_2$ which is in excess with respect to the quantity $C_2V_r$. If $t_n$ is the starting instant of a generic n-th period T, the electrical balance at the end of the entire subsequent period T will therefore be:

$$V_U(t_n+T) = V_U(t_n) - (V_K(t_n+T_1) - V_r)C_2/C_3.$$

If at the instant $t_n+T_1$ the voltage $V_K$ is lower than $V_r$, the output voltage $V_U$ will rise, causing the current $I_g$ to increase, so that the voltage $V_K$ at the end of the subsequent semiperiod $T_1$ (that is to say, at the instant $t_n+T+T_1$) will be greater than the voltage $V_K$ at the end of the present semiperiod $T_1$ (instant $t_n+T_1$). The opposite occurs if in the instant $t_n+T_1$ the voltage $V_K$ is higher than $V_r$.

The balancing condition in which $V_U(t_n+T)=V_U(t_n)$ is reached when $V_K=V_r$, i.e., taking into account equation (2), when the output voltage of operational amplifier A is such that:

$$I_g T_1/(C_1+C_2) = V_r,$$

from which follows:

$$I_g = V_r(C_1+C_2)/T_1 \quad (3)$$

In the typical case in which the duty-cycle of the clock signal CK is 50% (i.e., $T_1=T_2$), equation (3) can be written as:

$$I_g = 2fV_r(C_1+C_2) \quad (4)$$

where f (equal to 1/T) is the clock frequency. In practice, it is advantageous to make $C_1$ much greater than $C_2$, and therefore equation (4) can be reduced to:

$$I_g = 2fV_rC_1$$

The generated current $I_g$ can therefore be fixed with a high accuracy, and as a first approximation will be independent from the operating conditions of the integrated circuit for the same reasons already explained for the known solution.

Figure 5:
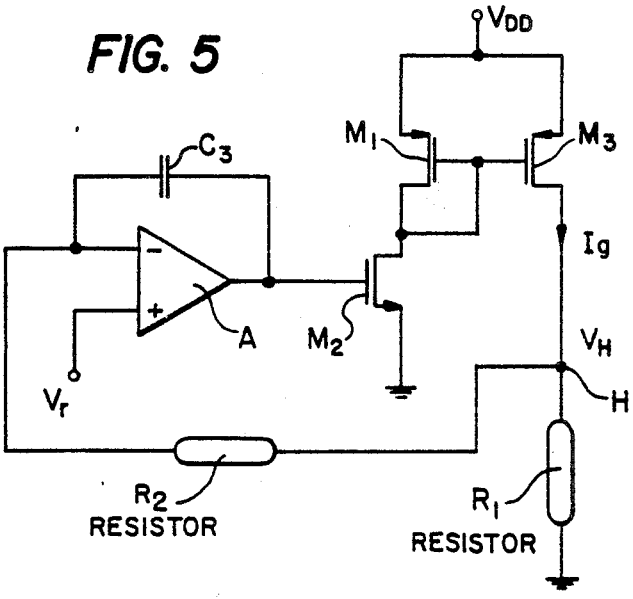
FIG. 5 is a time-continuous circuit diagram equivalent to the one of FIG. 4.

FIG. 5 shows the time-continuous circuit equivalent to the one in FIG. 4. The values of the resistors, obtained with the usual methods, are as follows:

$$R_1 = T_1/(C_1+C_2)$$

and $$R_2 = T/C_2$$

It has been seen that in the generator according to the invention the need for two power supplies with opposite polarities has been eliminated, since the reference voltage $V_r$ and the feedback voltage $V_H$ must have, in this case, the same polarity, in contrast to the known solution. At the same time, the generator according to the invention requires a smaller number of switches, and therefore turns out to be simpler and cheaper to manufacture.

Substantially, whereas in the known solution (in the real circuit implemented with a time-sampled method) the comparison is performed between two variable charges, accumulated in a predetermined time interval, and it is therefore necessary for the charges to have opposite polarities, according to the invention the comparison is performed between a fixed reference voltage and a variable voltage having the same polarity.

In the known solution shown in FIGS. 1 and 3, the integration, and therefore the filtering, time constant of the system was substantially $R_1C_3$, and with equal values of the reference voltage $V_r$ the value of the resistance $R_1$ is strictly bound to the value fo the generated current $I_g$, and drops as this value rises. Therefore, as the value of the generated current increases, in order to keep the filtering time constant fixed, it is necessary to increase accordingly the value of the feedback capacitor $C_3$, with a consequent increase in the occupied silicon area.

By contrast, in the circuit according to the invention, the integration time constant is substantially given by the product $R_2C_3$ (in the assumption practically always true, that $R_1$ is much smaller than $R_2$). This time constant, therefore, does not depend on the value of the generated current $I_g$: thus the block ($R_2$,$C_3$) may be sized independently from $I_g$, with consequent advantages both from the design point of view and from the point of view of silicon area occupation, and therefore from that of cheapness.

It is furthermore to be noted that in the known solution (FIG. 1) the capacitors $C_1$ and $C_2$ must have values of the same order so as to ensure that transistor $M_3$ operates in the saturation zone during the entire interval $T_1$, assuming $V_r$ is approximately half of $V_{SS}$, since otherwise equation (1) would not be verified. In the circuit of the invention, by contrast, the value of capacitor $C_2$ is independent from that of capacitor $C_1$, since the function of the group comprising capacitor $C_2$ and switch $S_2$ is that of "equivalent resistor" for the purpose of integration. Capacitor $C_2$ can therefore be manufactured with minimal size.

Figure 6:
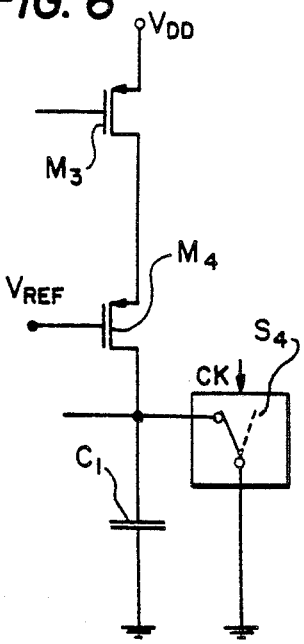
FIG. 6 is a partial circuit diagram, illustrating a variation of the generator of FIG. 4.

FIG. 6 shows a variant in the implementation of the output branch of the current mirror employed in the circuit of FIG. 4. In the output branch of the current mirror circuit, another transistor $M_4$ is connected in series with transistor $M_3$, which is controlled by a fixed reference voltage $V_{REF}$, which can coincide with $V_r$, according to the so-called cascode method, in order to improve the accuracy of the generated current. Other similar variants, based upon known improvements to the current mirror circuit, may be easily devised by the person skilled in the art.

Furthermore, in the preferred embodiments of the invention, shown in FIGS. 4, 5 and 6, as well as in all the equivalent variants, it is of course possible to replace each transistor with its complementary (N channel with P channel and vice versa). In this case the ground also must be exchanged with the power supply, by connecting the source electrodes of the current mirror to the ground, and the two capacitors $C_1$ and $C_2$, as well as switch $S_4$, to the positive power supply $V_{DD}$. These variations, together with others which can be contrived by a person skilled in the art, are obviously equivalent to the embodiments described and shown with reference to FIGS. 4, 5 and 6, and therefore are within the scope of the invention, as defined in the accompanying claims.

We claim:

1. A stabilized current generator comprising an operational amplifier with capacitive negative feedback whose output signal controls a current adjustment means for driving an input branch of a current mirror circuit, a current mirrored by said mirror circuit controlling a circuit feedback means for driving said operational amplifier so as to keep said mirrored current constant, wherein:

said circuit feedback means comprises a first capacitor and a first electronic switch in parallel, having one end at a fixed potential and having an opposite end fed by said mirrored current;

a second capacitor having one end at said fixed potential and having an opposite end connected to a second electronic switch adapted to connect said second capacitor to an inverting input of said operational amplifier in a first, inactive, position, and to a free end of said first capacitor in a second, active, position, said second electronic switch being controlled synchronously with said first electronic switch by a square-wave clock signal so that said first electronic switch is alternately open while said second electronic switch is in its active position and closed while said second electronic switch is in its inactive position;

and wherein a non-inverting input of said operational amplifier is connected to a fixed reference voltage source.

2. A stabilized current generator of claim 1, wherein said second capacitor has an extremely small value with respect to said first capacitor.

3. A stabilized current generator of claim 1, wherein said current adjustment means comprises an MOS transistor having its drain electrode connected to said input of said current mirror circuit and having its source electrode connected to said fixed potential.

4. A stabilized current generator of claim 1, wherein an output branch of said current mirror comprises a plurality of transistors connected in series.

5. A stabilized current generator of claim 4, wherein plurality transistors are connected in cascode.

6. A stabilized current generator of claim 1, wherein said fixed potential is a ground potential.

7. A stability current generator of claim 1, wherein said generated fixed potential is a fixed power supply voltage source.

8. A stabilized current generator of claim 1, comprising a single integrated circuit with MOS integration method.

9. A stabilized current generator of claim 8, connected so as to interact with other circuit functions installed on the same MOS integrated circuit.

* * * * *